US012631027B2

(12) United States Patent
Kasahara et al.

(10) Patent No.: US 12,631,027 B2
(45) Date of Patent: May 19, 2026

(54) ANCHORAGE AND PRESTRESSED CONCRETE (PC) STRUCTURE

(71) Applicant: SUMITOMO ELECTRIC INDUSTRIES, LTD., Osaka (JP)

(72) Inventors: Rei Kasahara, Osaka (JP); Yoshiyuki Matsubara, Osaka (JP); Motonobu Nishino, Osaka (JP); Yuka Kishimoto, Osaka (JP); Hiroki Shokawa, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 174 days.

(21) Appl. No.: 18/355,677

(22) Filed: Jul. 20, 2023

(65) Prior Publication Data

US 2024/0035280 A1 Feb. 1, 2024

(30) Foreign Application Priority Data

Jul. 27, 2022 (JP) ..... 2022-119697

(51) Int. Cl.
*E04C 5/12* (2006.01)

(52) U.S. Cl.
CPC ..... *E04C 5/12* (2013.01); *E04C 5/127* (2013.01)

(58) Field of Classification Search
CPC ... E04C 5/12; E04C 5/127; E04C 5/08; E04C 5/122
See application file for complete search history.

(56) References Cited

U.S. PATENT DOCUMENTS 2,935,776 A * 5/1960 Clark ..... F16G 11/05 403/314
3,061,482 A * 10/1962 Grant ..... C23C 24/08 148/284
3,163,904 A * 1/1965 Ziolkowski ..... F16G 11/048 425/111
3,520,032 A * 7/1970 Howlett ..... E04C 5/122 52/223.13
3,522,682 A * 8/1970 Annex ..... E04C 5/122 52/223.13
3,698,749 A * 10/1972 Yonkers ..... F16G 11/048 403/368
3,820,832 A * 6/1974 Brandestini et al. . F16G 11/048 403/368
3,952,377 A * 4/1976 Morell ..... E04C 5/122 403/374.2
3,999,418 A * 12/1976 Morell ..... E04C 5/122 279/123

(Continued)

FOREIGN PATENT DOCUMENTS

JP S62-063748 3/1987
JP S62-224669 10/1987

(Continued)

*Primary Examiner* — Jessie T Fonseca
(74) *Attorney, Agent, or Firm* — IPUSA, PLLC

(57) ABSTRACT

An anchorage for gripping and fixing an end portion of a tendon is provided. The anchorage includes a base having a surface; and a coating film provided at least on a contact portion of the surface of the base. The contact portion contacts the tendon when the tendon is gripped by the anchorage. The coating film has an electrical resistivity of $10^4$ Ω·m or more.

11 Claims, 6 Drawing Sheets

(56) References Cited

U.S. PATENT DOCUMENTS

| | | | | | |
|---|---|---|---|---|---|
| 4,343,122 | A * | 8/1982 | Wlodkowski | E04C 5/122 | 52/223.13 |
| 4,388,014 | A * | 6/1983 | Wlodkowski | E04C 5/122 | 403/374.2 |
| 4,633,540 | A * | 1/1987 | Jungwirth | E04C 5/122 | 52/223.13 |
| 4,662,134 | A * | 5/1987 | Illgner | E04C 5/122 | 52/223.13 |
| 4,773,198 | A * | 9/1988 | Reinhardt | E04C 5/122 | 52/223.13 |
| 5,058,469 | A * | 10/1991 | Rodriguez | E04G 21/12 | 83/13 |
| 7,950,196 | B1 * | 5/2011 | Sorkin | E04G 21/12 | 403/374.1 |
| 2002/0129570 | A1 * | 9/2002 | Sorkin | E04C 5/12 | 52/223.13 |
| 2005/0284050 | A1 * | 12/2005 | Hayes | E04C 5/12 | 52/223.13 |
| 2006/0179742 | A1 * | 8/2006 | Mathews | E04C 5/122 | 52/223.13 |
| 2013/0269125 | A1 * | 10/2013 | Grace | E01D 19/125 | 14/73 |
| 2017/0204607 | A1 * | 7/2017 | Schmidt | E04C 5/122 | |

FOREIGN PATENT DOCUMENTS

| | | |
|---|---|---|
| JP | H03-172441 | 7/1991 |
| JP | 2002-213048 | 7/2002 |
| JP | 2012-074650 | 4/2012 |
| JP | 2021-194812 | 12/2021 |

* cited by examiner

ANCHORAGE AND PRESTRESSED CONCRETE (PC) STRUCTURE

CROSS-REFERENCE TO RELATED APPLICATIONS

This application is based on and claims priority to Japanese Patent Application No. 2022-119697, filed on Jul. 27, 2022, the entire contents of which are incorporated herein by reference.

TECHNICAL FIELD

The present disclosure relates to an anchorage and a prestressed concrete (PC) structure.

BACKGROUND

Japanese Laid-Open Patent Publication No. 2021-194812 (Patent Document 1) describes a prestressed concrete pole that includes an elongated concrete article and a tendon. The tendon is disposed inside the concrete article and consists of a fiber reinforced composite cable formed by twisting a plurality of reinforcing fiber bundles.

SUMMARY

According to an aspect of the present disclosure, an anchorage for gripping and fixing an end portion of a tendon is provided. The anchorage includes a base having a surface; and a coating film provided at least on a contact portion of the surface of the base. The contact portion contacts the tendon when the tendon is gripped by the anchorage. The coating film has an electrical resistivity of $10^4$ Ω·m or more.

BRIEF DESCRIPTION OF THE DRAWINGS

Other objects and further features of the present invention will be apparent from the following detailed description when read in conjunction with the accompanying drawings, in which.

DETAILED DESCRIPTION

Figure 1:
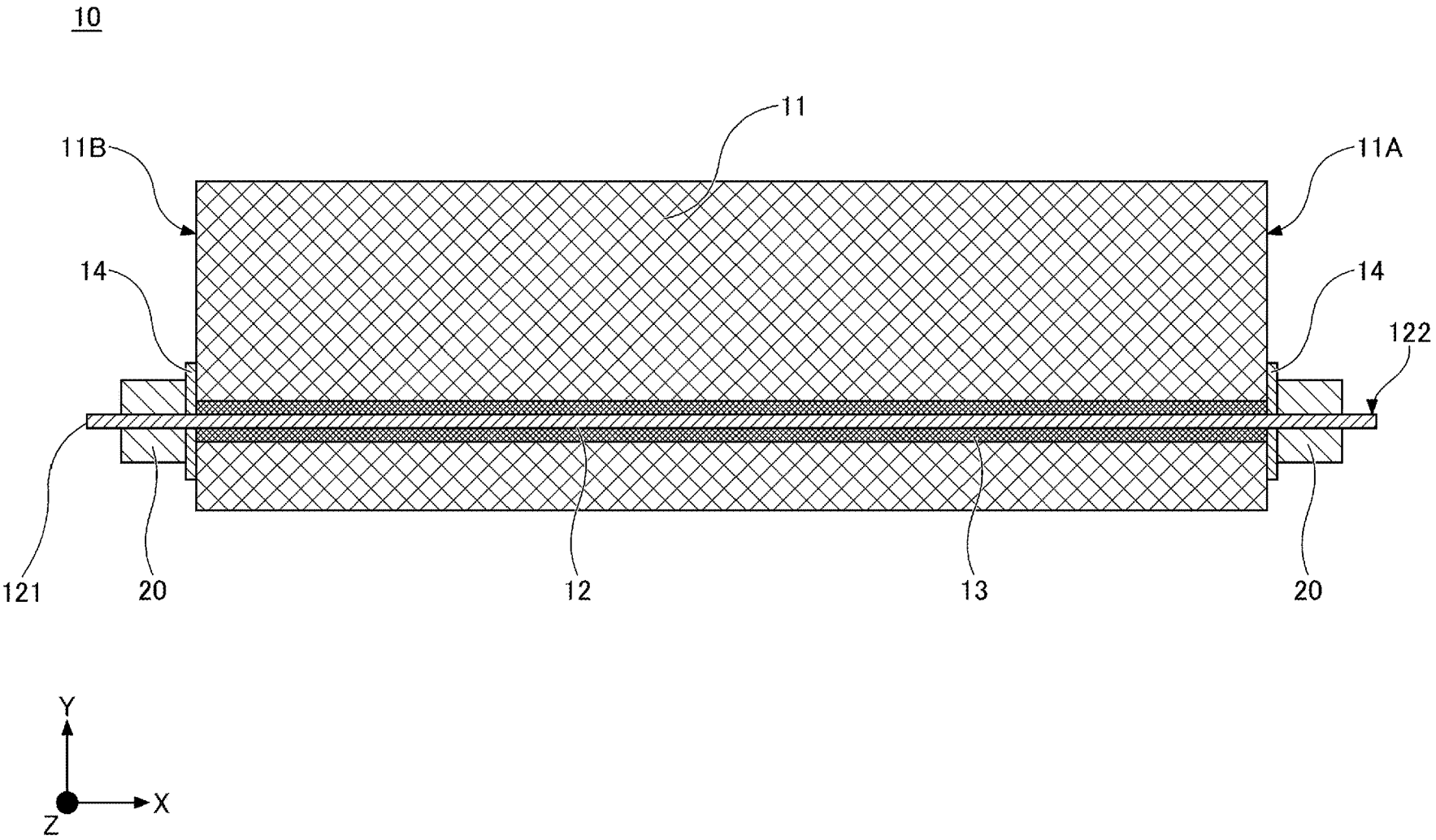
FIG. 1 is a drawing illustrating a PC structure.

Tendons such as PC steel strands or PC steel bars are conventionally used to apply a tensile force to a concrete structure.

Concrete structures may be installed, for example, near the sea, under the sea, or in heavy snowfall areas. If a concrete structure is installed in an area as described above, tendons may easily corrode due to the influence of seawater, an anti-freezing agent sprayed on the road, or the like. Therefore, as disclosed in Patent Document 1 above and the like, tendons having corrosion resistance have been studied.

In the case of a post-tensioning system, each end portion of a tendon is gripped by an anchorage, and a tensile force applied to the tendon is maintained, thereby allowing a compressive force to be continuously applied to a concrete structure. However, in a case where a tendon having corrosion resistance as described above is used, corrosion may occur between the tendon and an anchorage if moisture enters between the tendon and the anchorage.

According to the present disclosure, an anchorage capable of minimizing the occurrence of corrosion between a tendon and the anchorage can be provided.

In the following, embodiments of the present disclosure will be described.

Description of Embodiments of Present Disclosure

First, the embodiments of the present disclosure will be listed and described. In the following description, the same or corresponding components are denoted by the same reference numerals and the description thereof will not be repeated.

(1) According to an aspect of the present disclosure, an anchorage for gripping and fixing an end portion of a tendon is provided. The anchorage includes a base having a surface; and a coating film provided at least on a contact portion of the surface of the base. The contact portion contacts the tendon when the tendon is gripped by the anchorage. The coating film has an electrical resistivity of $10^4$ Ω·m or more.

By setting the electrical resistivity of the coating film to $10^4$ Ω·m or more, the coating film having a sufficiently high electrical resistivity can be obtained. In addition, the coating film is provided at least on the contact portion of the surface of the base that contacts the tendon when the tendon is gripped by the anchorage. Therefore, even if water or the like enters between the tendon and the anchorage, an electric current can be prevented from flowing between the tendon and the anchorage. Accordingly, the anchorage according to the aspect of the present disclosure can minimize the occurrence of corrosion between the anchorage and the tendon.

(2) In the above (1), the coating film may have a thickness of 50 nm or more and 100 μm or less.

By setting the thickness of the coating film to 50 nm or more, the occurrence of pinholes can be minimized, and in particular, the occurrence of corrosion between the tendon and the anchorage can be minimized. Further, the coating film is provided on the contact portion that contacts the tendon. Therefore, by setting the thickness of the coating film to 50 nm or more, the durability of the coating film can be improved.

By setting the thickness of the coating film to 100 μm or less, cracking of the coating film can be prevented.

(3) In the above (1) or (2), the base may include a male cone and a female cone. The male cone has a first through hole into which the tendon is inserted, and the female cone has a second through hole into which the male cone is inserted.

When the base of the anchorage includes the male cone and the female cone, the anchorage can be applied to various types of tendons.

(4) In the above (3), the coating film may be provided on a portion of a surface of the first through hole of the male cone.

The portion of the surface of the first through hole serves as a contact portion that contacts the tendon. Thus, by providing the coating film on the portion of the surface of the first through hole, an electric current can be prevented from flowing between the tendon and the anchorage even if water or the like enters between the tendon and the anchorage. Accordingly, the occurrence of corrosion between the tendon and the anchorage, specifically the occurrence of corrosion at the contact portion between the tendon and the anchorage can be minimized.

(5) In the above (3) or (4), the coating film may be provided on an entirety of one or more surfaces selected from a surface of the first through hole of the male cone and an outer surface of the male cone.

By providing the coating film on the entirety of one or more surfaces selected from the surface of the first through hole of the male cone and the outer surface of the male cone, corrosion of the male cone in particular can be prevented. Accordingly, the durability of the male cone can be improved.

(6) In any of the above (3) to (5), the coating film may be provided on an entirety of one or more surfaces selected from a surface of the second through hole of the female cone and an outer surface of the female cone.

By providing the coating film on the entirety of one or more surfaces selected from the surface of the second through hole of the female cone and the outer surface of the female cone, corrosion between the female cone and a member such as the male cone can be prevented. Accordingly, the durability of the female can be improved.

(7) In any of the above (3) to (6), the male cone may have a plurality of teeth on a surface of the first through hole.

When the male cone has the plurality of teeth on the surface of the first through hole, the teeth can press the tendon when the anchorage is installed on the tendon. Accordingly, the anchorage can be firmly installed on the tendon.

(8) In any of the above (3) to (7), the coating film provided in the first through hole may have a hardness of 500 HV or more and 10,000 HV or less.

By setting the hardness of the coating film provided in the first through hole to 500 HV or more, the anchorage having excellent durability can be obtained.

Further, by setting the hardness of the coating film provided in the first through hole to 10,000 HV or less, the productivity of the anchorage can be improved.

(9) According to an aspect of the present disclosure, a prestressed concrete (PC) structure includes a tendon; and the anchorage of any of the above (1) to (8) to be attached to an end portion of the tendon.

The PC structure according to the aspect of the present disclosure can have excellent durability while minimizing the occurrence of corrosion.

(10) In the above (9), the tendon may be one or more selected from a PC steel wire made of stainless steel, a PC steel wire having a zinc coating, a PC steel wire having a copper coating, and a carbon fiber composite cable.

In the PC structure according to the present disclosure, even if the tendon is a PC steel wire made of stainless steel or the like, durability can be improved while minimizing the occurrence of corrosion between the tendon and the anchorage, unlike a conventional tendon that is a PC steel wire made of stainless steel and in which corrosion would easily occur.

Details of Embodiments of Present Disclosure

Specific examples of an anchorage and a PC structure according to an embodiment (hereinafter referred to as the "present embodiment") of the present disclosure will be described below with reference to the accompanying drawings. Note that the present invention is not limited to these examples, and is intended to include all changes and modifications within the scope of the appended claims and within the meaning and scope of the equivalents of the appended claims.

[Anchorage]

1. Installation State of Anchorage

Before describing the anchorage and a method of installing the anchorage according to the present embodiment, the installation state of the anchorage according to the present embodiment will be described with reference to FIG. 1.

FIG. 1 is a drawing illustrating a state in which a tensile force is applied to a tendon 12 disposed in a concrete structure 11, and the tendon 12 is fixed to the concrete structure 11 by an anchorage 20. FIG. 1 schematically illustrates a cross-sectional view taken along a plane parallel to the central axis of the tendon 12. The X-axis in FIG. 1 is an axis extending in the longitudinal direction of the tendon 12.

As illustrated in FIG. 1, the tendon 12 can be disposed within the concrete structure 11 with a sheath 13 being interposed between the tendon 12 and the concrete structure 11. The tendon 12 is a prestressing tendon that applies prestress, specifically, a compressive force to the concrete structure 11. The tendon 12 can be a PC steel strand including a plurality of stranded wires, a PC steel bar, a carbon fiber composite cable, or the like. Note that "PC" such as the above "PC" steel strand means "prestressed concrete".

In FIG. 1, a first end portion 121 and a second end portion 122, which are two end portions in the longitudinal direction of the tendon 12, are each gripped by the anchorage 20. The tendon 12 is pulled along its longitudinal direction, that is, along the X-axis such that a tensile force is applied to the tendon 12 in advance. Therefore, a force that causes the tendon 12 to contract in its longitudinal direction is applied to the tendon 12.

A bearing plate 14 is disposed between the concrete structure 11 and the anchorage 20. The bearing plate 14 can be disposed on each of a first surface 11A and a second surface 11B, and can support the tensile force applied to the tendon 12. The first surface 11A and a second surface 11B are surfaces from which the tendon 12 of the concrete structure 11 extend outward. The bearing plate 14 is a plate-shaped body having a hole in the center through which the tendon 12 passes. The bearing plate 14 is also referred to as a casting plate or the like.

The bearing plate 14 can support the anchorage 20, and transmit the force, which is applied to the tendon 12 to cause the tendon 12 to contract in its longitudinal direction, to the concrete structure 11, thereby allowing a compressive force to be applied to the concrete structure 11.

A structure that includes the tendon 12 and the anchorage 20 installed on the tendon 12 as illustrated in FIG. 1 can be referred to as a PC structure 10. As illustrated in FIG. 1, the PC structure 10 can also include the concrete structure 11 in which the tendon 12 is disposed, the sheath 13, and the bearing plate 14.

2. Configuration of Anchorage

As described with reference to FIG. 1, the anchorage 20 according to the present embodiment is configured to grip the end portion of the tendon 12 and fix the tendon 12 to the concrete structure 11.

Steel such as carbon steel is conventionally used as the material of a tendon and an anchorage. However, from the viewpoint of improving corrosion resistance as described above, there may be cases where stainless steel or a material other than steel, such as a carbon material, is used as the material of the tendon or where a coating such as plating is provided on the surface of the tendon.

Conversely, from the viewpoint of workability and strength, steel is often used for a portion of the anchorage that contacts the tendon.

Therefore, there may be cases where different materials are used for the tendon and the anchorage. In such a case, if water or the like enters a contact portion between the tendon and the anchorage, it is conceivable that an electric current (corrosion current) will flow through the contact portion due to the potential difference between the tendon and the anchorage, and as a result, the contact portion will corrode.

In view of the above-described mechanism of corrosion, the anchorage according to the present embodiment can include a base and a coating film. The coating film is provided at least on a contact portion of the surface of the base that contacts the tendon when the tendon is gripped by the anchorage.

In the following, members included in the anchorage according to the present embodiment will be described.

(1) Members of Anchorage (1-1) Coating Film (Electrical Resistivity)

The electrical resistivity of a coating film is $10^4$ Ω·m or more, and more preferably $10^5$ Ω·m or more.

The upper limit of the electrical resistivity of the coating film is not particularly limited. The electrical resistivity of the coating film is preferably $10^8$ Ω·m or less, and more preferably $10^7$ Ω·m or less.

By setting the electrical resistivity of the coating film to $10^4$ Ω·m or more, the coating film having a sufficiently high electrical resistivity can be obtained. In addition, the coating film is provided at least on the contact portion of the surface of the base that contacts the tendon when the tendon is gripped by the anchorage. Thus, even if water or the like enters between the tendon and the anchorage, an electric current can be prevented from flowing between the tendon and the anchorage. Accordingly, the anchorage according to the present embodiment can minimize the occurrence of corrosion between the tendon and the anchorage, specifically the occurrence of corrosion at the contact portion between the tendon and the anchorage.

The electrical resistivity of the coating film can be measured by a two-terminal method.

(Thickness)

The thickness T23 (see FIG. 2) of the coating film is not particularly limited. For example, the thickness T23 of the coating film is preferably 50 nm or more and 100 μm or less, and more preferably 500 nm or more and 20 μm or less.

By setting the thickness of the coating film to 50 nm or more, the occurrence of pinholes can be minimized, and in particular, the occurrence of corrosion between the tendon and the anchorage can be minimized. Further, the coating film is provided on the contact portion that contacts the tendon. Therefore, by setting the thickness of the coating film to 50 nm or more, the durability of the coating film can be improved.

By setting the thickness of the coating film to 100 μm or less, cracking of the coating film can be prevented.

A method of evaluating the thickness of the coating film is not particularly limited. For example, the anchorage is processed by a focused ion beam (FIB) apparatus or the like so as to expose a cross section along the thickness of the coating film. Then, the cross section is observed by scanning electron microscopy (SEM) and the thickness of the coating film is measured. In this manner, the thickness of the coating film can be evaluated.

The thickness of the coating film of the anchorage is not required to be constant, as long as the thickness of the coating film is in the above-described ranges.

(Material of Coating Film)

The material of the coating film is not particularly limited. As the material of the coating film, a material having electrical resistivity in the above-described range can be used. From the viewpoint of abrasion resistance, surface hardness, and the like, the material of the coating film is preferably an inorganic material, and can be, for example, a ceramic or the like.

Specifically, for example, one or more selected from zirconium oxide ($ZrO_2$), silicon nitride ($Si_3N_4$), diamond-like carbon (DLC), diamond, aluminum oxide ($Al_2O_3$), and aluminum nitride (AlN) can be used.

The coating film may include two or more materials, or may be a laminated film of two or more layers.

A method of forming the coating film is not particularly limited, and can be selected according to the material or the like of the coating film. For example, a physical vapor deposition (PVD) method or a chemical vapor deposition (CVD) method can be preferably used. If the coating film is formed by the CVD method, the coating film can be uniformly formed with a high productivity and can be firmly attached to the base. Thus, the CVD method is more preferably used.

(Hardness)

The Vickers hardness of the coating film provided on the contact portion is preferably 500 HV or more and 10,000 HV or less, and more preferably 500 HV or more and 2,500 HV or less.

By setting the hardness of the coating film provided on the contact portion to 500 HV or more, the anchorage having excellent durability can be obtained.

Further, by setting the hardness of the coating film provided on the contact portion to 10,000 HV or less, the productivity of the anchorage can be improved.

The Vickers hardness can be measured according to JIS Z 2255 (2003). For example, the Vickers hardness is obtained by converting a measurement value measured by using a nanoindenter into a Vickers hardness value. The measurement conditions are not particularly limited. The following procedures and conditions can be used, for example.

A triangular pyramidal Berkovich indenter is attached to a nanoindenter. In a state in which the Berkovich indenter contacts the coating film, the indenter is loaded from 0 mN to 0.5 mN in 3 seconds, is maintained at 0.5 mN for 1 second, and is unloaded from 0.5 mN to 0 mN in 3 seconds to form an indentation in the coating film.

Next, the projected area of the indentation is calculated from a load-displacement curve of the indenter, and the nanoindentation hardness of the coating film is calculated by using the projected area of the indentation and the maximum load of the indenter. Then, the nanoindentation hardness (GPa) is converted into the Vickers hardness HV by using a factor of 94.5. That is, the Vickers hardness HV is calculated by HV=94.5×NH, where NH denotes the nanoindentation hardness.

As will be described later, the anchorage can include a male cone and a female cone. The male cone and the female cone serve as the base.

In this case, at least a portion of a surface 212 of a first through hole 211 of a male cone 21 (see FIGS. 2, 6, and 7) serves as a contact portion that contacts the tendon when the tendon is gripped by the anchorage. Therefore, a coating film 23 can be disposed at least on the portion of the surface 212 of the first through hole 211.

In the above case, the Vickers hardness of the coating film 23 provided in the first through hole 211 of the male cone 21 is preferably 500 HV or more and 10,000 HV or less, and more preferably 500 HV or more and 2,500 HV or less. The reasons why the coating film 23 having such a hardness is preferable has already been described above, and thus the description thereof will be omitted.

(1-2) Base

The base of the anchorage according to the present embodiment may be any member that can grip and fix the tendon. The configuration of the base is not particularly limited.

For example, the base of the anchorage can include the male cone and the female cone. Such male cone and female cone are conventionally used as an anchorage.

When the base of the anchorage includes the male cone and the female cone, the anchorage can be applied to various types of tendons.

Figure 2:
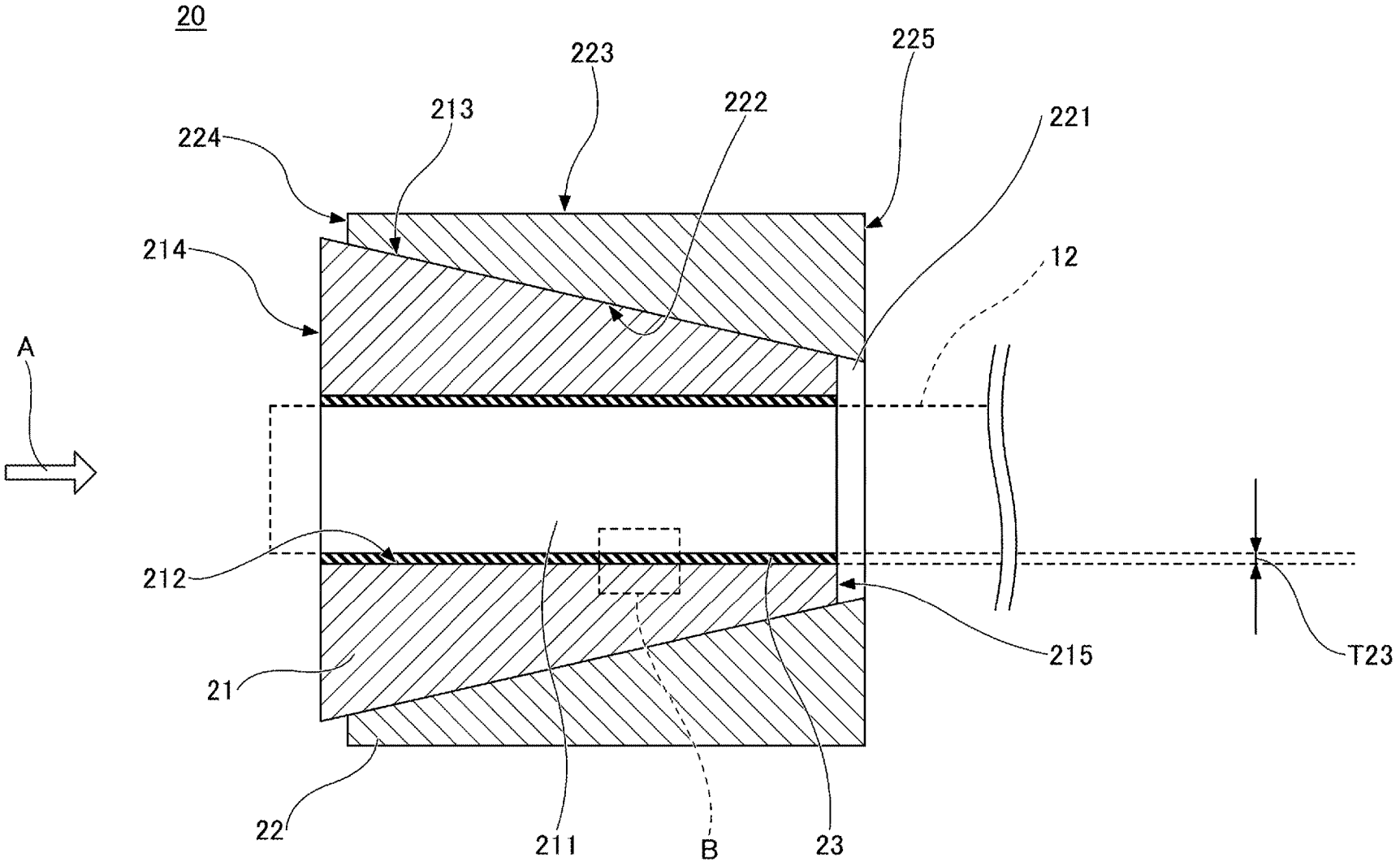
FIG. 2 is a cross-sectional view of an anchorage including a male cone and a female cone according to an embodiment of the present disclosure.
Figure 3:
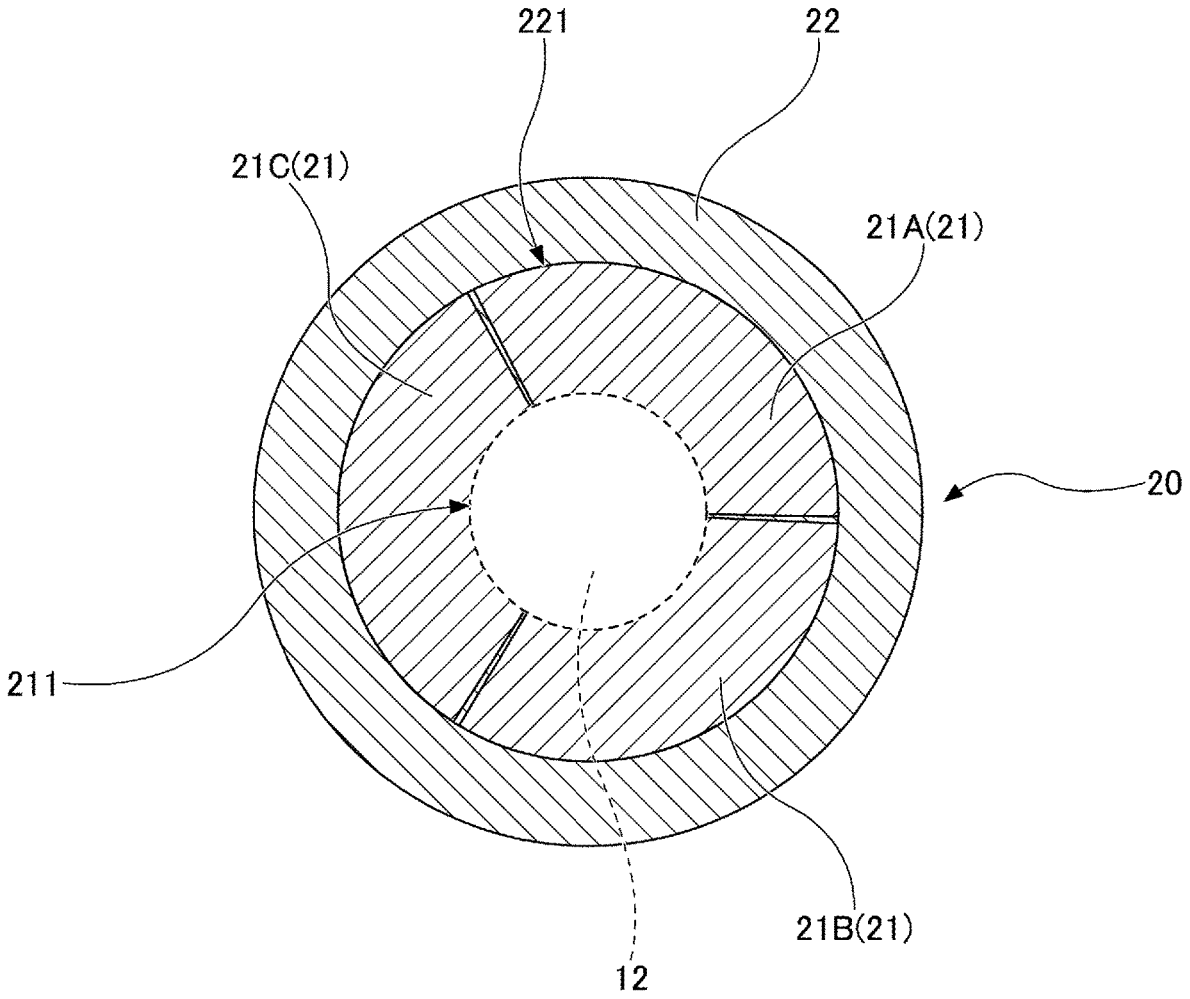
FIG. 3 is a side view of the anchorage including the male cone and the female cone according to the embodiment of the present disclosure.

FIG. 2 is a cross-sectional view of the anchorage 20 including the male cone 21 and a female cone 22 in a plane passing through the central axis of the anchorage 20. FIG. 3 is a side view of the anchorage 20 as viewed in a direction of a block arrow A of FIG. 2. In FIG. 3, the coating film 23 is not depicted.

(Male Cone)

The male cone 21 can have the first through hole 211 in which the tendon 12 is inserted along the central axis.

The outer shape of the male cone 21 can conform to the tapered shape of a second through hole 221 of the female cone 22, which will be described later. For example, the male cone 21 can have a truncated cone shape.

As illustrated in FIG. 3, the male cone 21 can include a plurality of male cone members 21A, 21B, and 21C divided along the circumferential direction. In the example illustrated in FIG. 3, the male cone 21 is divided into three male cone members; however, the male cone 21 can include two male cone members or four or more male cone members. Further, the male cone 21 can be constituted by one member without being divided. If the male cone 21 includes a plurality of male cone members, the male cone 21 can be formed into a truncated cone shape having the first through hole 211 as described above by combining the plurality of male cone members.

The surface 212 of the first through hole 211 of the male cone 21 can have projections and recesses such that the tendon 12 can be firmly gripped. The projections provided on the surface of the first through hole 211 press the tendon 12, and thus, projections can be also referred to as teeth.

Figure 6:
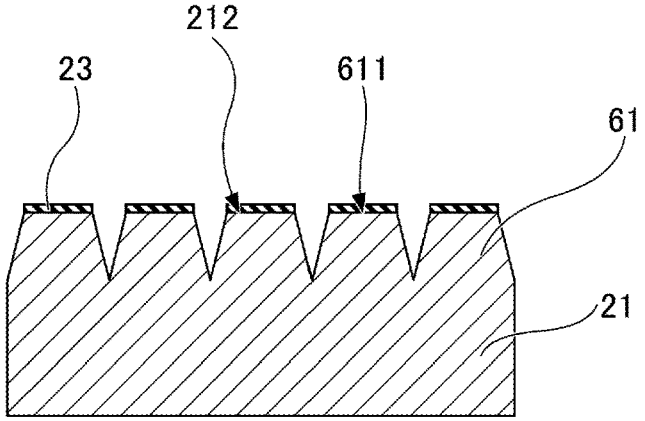
FIG. 6 is a drawing illustrating an example configuration of teeth.
Figure 7:
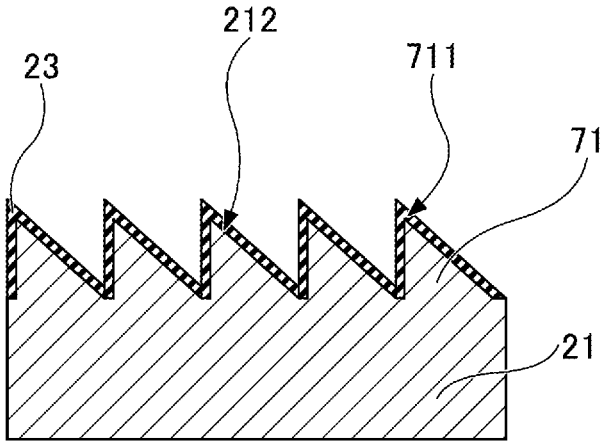
FIG. 7 is a drawing illustrating an example configuration of teeth.

FIG. 6 and FIG. 7 illustrate examples of enlarged views of a region B of FIG. 2. The region B is a portion of the surface of the first through hole 211.

As illustrated in FIG. 6, the male cone 21 can have a plurality of teeth 61 on the surface 212 of the first through hole 211. The shape of each of the teeth 61 is not limited to a trapezoid shape as illustrated in FIG. 6 in a cross-sectional view, and may be a triangular shape as the teeth 71 illustrated in FIG. 7 in a cross-sectional view. Further, the shape of each of the teeth 61 may be a semicircular shape.

When the male cone 21 has the plurality of teeth on the surface 212 of the first through hole 211, the teeth can press the tendon 12 when the anchorage 20 is installed on the tendon 12. Thus, the anchorage 20 can be firmly installed on the tendon 12.

(Female Cone)

The outer shape of the female cone 22 is not particularly limited. For example, the female cone 22 can have a cylindrical shape.

The female cone 22 has the second through hole 221 into which the male cone 21 is inserted. Specifically, the female cone 22 can have the second through hole 221 into which the tendon 12 and the male cone 21 are inserted along the central axis. As illustrated in FIG. 2, the second through hole 221 can have a tapered shape whose diameter increases from a third outer surface 225, which is disposed to face the concrete structure 11, to a second outer surface 224 having an opening for inserting the male cone 21.

The anchorage 20 including the base that includes the male cone 21 and the female cone 22 as described above is used as follows. With the tendon 12 being inserted into the first through hole 211, the male cone 21 is inserted from the second outer surface 224, which is the left side surface of the female cone 22 in FIG. 2, into the second through hole 221. When the male cone 21 is pressed into the second through hole 221 of the female cone 22, the male cone 21 tightens the tendon 12, and thus, the anchorage 20 can be fixed to the tendon 12.

(Material of Base)

The material of the base of the anchorage is not particularly limited. When the anchorage 20 includes the male cone 21 and the female cone 22, for example, one or more selected from chromium molybdenum steel (SCM material), stainless steel, a copper alloy, carbon steel for machine structural use (SC material), tool steel, and cast iron can be used for the male cone 21. Further, one or more selected from chromium molybdenum steel (SCM material), carbon steel for machine construction (SC material), stainless steel, a copper alloy, carbon steel, tool steel, and cast iron can be used for the female cone 22, for example.

If stainless steel is used for the male cone 21 and the female cone 22, one or more selected from austenitic stainless steel such as SUS304 and SUS316, duplex stainless steel such as SUS329, and precipitation hardening stainless steel such as SUS630 are preferably used as the stainless steel.

If carbon steel for machine structural use (SC material) is used for the male cone 21 and the female cone 22, one or more selected from S45C, S55C, and the like are preferably used as the carbon steel for machine structural use (SC material).

(1-3) Underlayer

An underlayer can be disposed between the coating film and the base for the purposes of enhancing the adhesion between the coating film and the base and adding additional functions to the anchorage. The material of the underlayer is not particularly limited. For example, one or more selected from zinc, titanium, chromium, silicon, tungsten, and stainless steel can be used.

(2) Coating Film

As described above, the coating film can be provided on a contact portion of the surface of the base. The contact portion contacts the tendon when the tendon is gripped by the anchorage.

If the anchorage 20 includes the above-described male cone 21 and female cone 22, the coating film 23 can be provided on a portion of the surface 212 of the first through hole 211 of the male cone 21.

The portion of the surface 212 of the first through hole 211 serves as a contact portion that contacts the tendon 12. Therefore, by providing the coating film 23 on the portion of the surface 212 of the first through hole 211, an electric current can be prevented from flowing between the tendon and the anchorage even if water or the like enters between the tendon and the anchorage. Accordingly, the occurrence of corrosion between the tendon and the anchorage, specifically the occurrence of corrosion at the contact portion between the tendon and the anchorage can be minimized.

For example, if the surface 212 of the first through hole 211 is a flat surface, the coating film 23 may be provided on the entirety of the surface 212.

As illustrated in FIG. 6, if the teeth 61 are provided on the surface 212 of the first through hole 211, a surface 611, which is the upper surface of each of the teeth 61, serves as a contact portion that contacts the tendon 12. Therefore, as illustrated in FIG. 6, the coating film 23 can be provided on the surface 611 of each of the teeth 61. However, in this case, the coating film 23 may be continuously provided on the entirety of the surfaces of the teeth 61.

Further, as illustrated in FIG. 7, if the teeth 71 are provided on the surface 212 of the first through hole 211, the coating film 23 may be provided on the entirety of the surfaces of the teeth 71, or may be provided on only a top portion 711 of each of the teeth 71. The top portion 711 of each of the teeth 71 serves as a contact portion that contacts the tendon 12.

The coating film 23 may be provided on any portion of the surface of the male cone 21 other than the above-described contact portions.

For example, the coating film 23 may be provided on the entirety of one or more surfaces selected from the surface 212 of the first through hole 211 and outer surfaces of the male cone 21.

By providing the coating film on the entirety of one or more surfaces selected from the surface 212 of the first through hole 211 and the outer surfaces of the male cone 21, corrosion of the male cone 21 in particular can be prevented. Accordingly, the durability of the male cone 21 can be improved.

Figure 4:
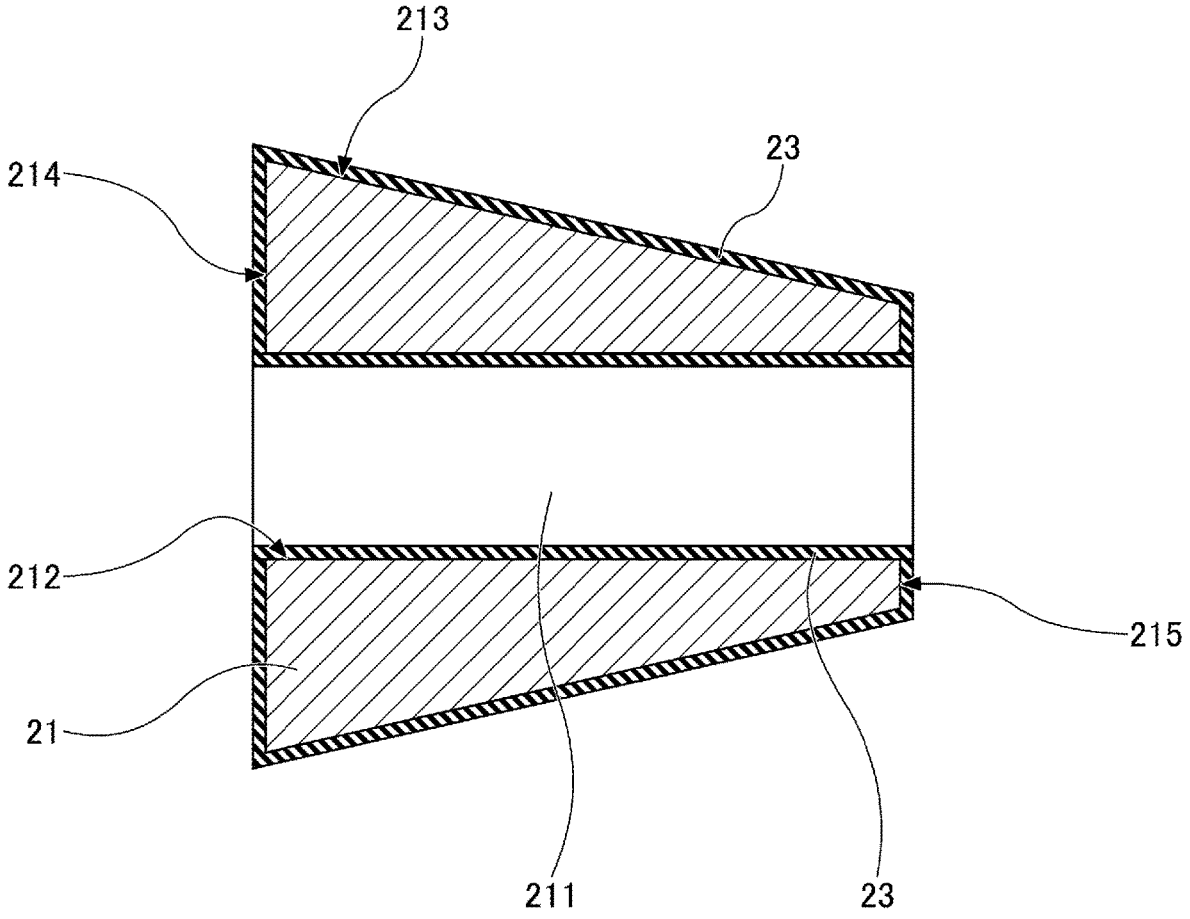
FIG. 4 is a drawing illustrating a male cone in which a coating film is disposed on the entirety of a surface of a first through hole and on the entirety of outer surfaces.

The outer surfaces of the male cone 21 refer to a first outer surface 213, a second outer surface 214, and a third outer surface 215 in FIG. 2 and FIG. 4.

For example, as illustrated in FIG. 4, the male cone 21 can have the coating film 23 on the entirety of the surface 212 (of the first through hole 211), the first outer surface 213, the second outer surface 214, and the third outer surface 215. By providing the coating film on the entirety of the surfaces of the male cone 21, corrosion of the male cone 21 in particular can be prevented.

Further, the coating film 23 may be provided on a portion of the surface of the female cone 22.

For example, the coating film 23 may be provided on the entirety of one or more surfaces selected from a surface 222 of the second through hole 221 and outer surfaces of the female cone 22.

By providing the coating film on the entirety of one or more surfaces selected from the surface 222 of the second through hole 221 and the outer surfaces of the female cone 22, corrosion between the female cone 22 and the male cone 21 in particular can be prevented. Accordingly, the durability of the female cone 22 can be improved.

Figure 5:
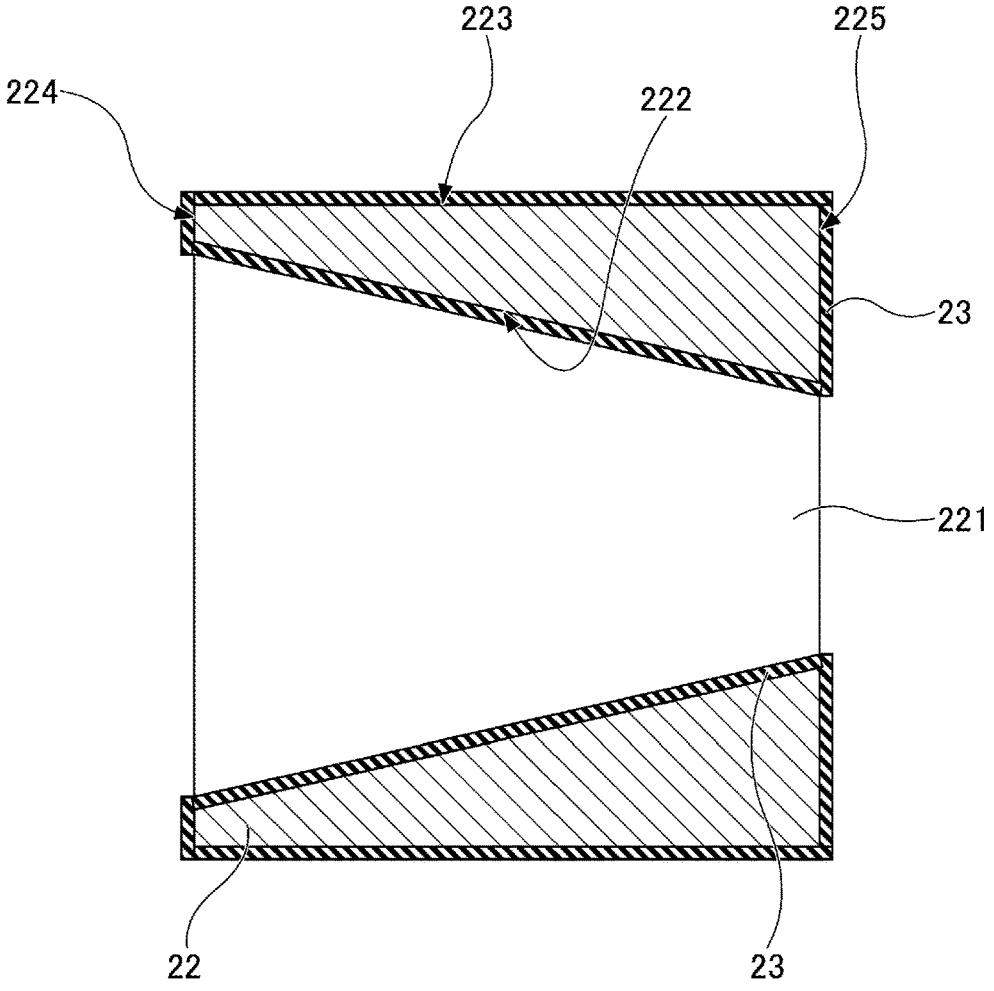
FIG. 5 is a drawing illustrating a female cone in which a coating film is disposed on the entirety of a surface of a second through hole and the entirety of outer surfaces.

The outer surfaces of the female cone 22 refer to a first outer surface 223, the second outer surface 224, and the third outer surface 225 in FIG. 2 and FIG. 5.

For example, as illustrated in FIG. 5, the female cone 22 can have the coating film 23 on the entirety of the surface 222 (of the second through hole 221), the first outer surface 223, the second outer surface 224, and the third outer surface 225.

[PC Structure]

As described with reference to FIG. 1, the PC structure 10 according to the present embodiment can include the tendon 12 and the anchorage 20 according to the present disclosure attached to each end portion of the tendon 12.

The anchorage 20 according to the present disclosure includes the base and the coating film. The coating film has a predetermined electrical resistivity, and is provided at least on a contact portion of the surface of the base. The contact portion contacts the tendon when the tendon is gripped by the anchorage 20. Accordingly, even if water or the like enters between the tendon and the anchorage, an electric current can be prevented from flowing between the tendon and the anchorage, and thus, the occurrence of corrosion at the contact portion between the tendon and the anchorage can be minimized. Therefore, the PC structure 10 according to the present embodiment can have excellent durability while minimizing the occurrence of corrosion.

The type of the tendon 12 of the PC structure 10 is not particularly limited. For example, the tendon 12 can be PC steel, a PC steel bar, a carbon fiber composite cable, or the like.

In the PC structure according to the present embodiment, the occurrence of corrosion between the tendon 12 and the anchorage 20 can be minimized. Thus, at least the surface of the tendon 12 is preferably formed of a material different from that of the anchorage 20, for example, the male cone 21. In the case of a tendon having corrosion resistance, since the material of the tendon differs from that of the anchorage 20, corrosion would easily occur particularly between the tendon and the anchorage 20. Conversely, according to the present embodiment, corrosion between the tendon 12 and the anchorage 20 can be minimized. Therefore, the tendon 12 preferably has corrosion resistance, and the tendon 12 is preferably one or more selected from a PC steel wire made of stainless steel, a PC steel wire having a zinc coating, a PC steel wire having a copper coating, and a carbon fiber composite cable. The above PC steel wire includes a PC steel strand and a PC steel bar.

If the tendon 12 is a PC steel strand, a PC steel strand having an outer diameter of 12.7 mm or more and 15.7 mm or less can be suitably used.

In the PC structure according to the present embodiment, even if the tendon 12 is a PC steel wire made of stainless steel or the like, durability can be improved while minimizing the occurrence of corrosion between the tendon 12 and the anchorage 20, unlike a conventional tendon that is a PC steel wire made of stainless steel and in which corrosion would easily occur.

EXAMPLES

In the following, specific examples will be described; however, the present invention is not limited to these examples.

The conditions and results of Experimental Examples will be described below. Experimental Examples 1 and 2 are examples according to the present disclosure, whereas Experimental Example 3 is a comparative example.

Experimental Example 1

As illustrated in FIG. 2, an anchorage 20 including a male cone 21 and a female cone 22, which serve as a base, was prepared. The male cone 21 and female cone 22 were made of chromium molybdenum steel.

As illustrated in FIG. 7, teeth 71 were provided on a surface 212 of a first through hole 211 of the male cone 21.

Each of the teeth 71 was continuously provided along the inner circumference of the first through hole 211. In addition, as illustrated in FIG. 7, the plurality of teeth 71 were arranged in the longitudinal direction of the first through hole 211. FIG. 7 corresponds to the enlarged view of the region B of FIG. 2, and is a partially enlarged view of the cross-sectional view along the central axis of the anchorage 20. Each of the teeth 71 has a triangular shape in a cross-sectional view.

As illustrated in FIG. 4, a coating film 23 made of DLC was provided by the CVD method on the entirety of the surfaces of the male cone 21, that is, on the surface 212 of the first through hole 211, a first outer surface 213, a second outer surface 214, and a third outer surface 215. The first outer surface 213, the second outer surface 214, and the third outer surface 215 are the outer surfaces of the male cone 21. Note that the coating film 23 was continuously provided on the entirety of the surface 212 of the first through hole 211 as illustrated in FIG. 7, instead of being provided only on a top portion 711 of each of the teeth 71.

The electrical resistivity of the coating film 23 was measured at any 3 points on the coating film 23 by the two-terminal method. The electrical resistivity was in the range of $10^5$ Ω·m to $10^6$ Ω·m. In addition, an anchorage was produced under the same conditions and was cut by the FIB apparatus so as to expose a cross section along the thickness of the coating film 23, and the cross section was observed by scanning electron microscopy. As a result, it was confirmed that the thickness of the coating film was in the range of 0.5 μm to 5 μm.

As illustrated in FIG. 5, a coating film 23 made of DLC was provided by the CVD method on the entirety of the surfaces of the female cone 22, that is, on a surface 222 of a first through hole 221, a first outer surface 223, a second outer surface 224, and a third outer surface 225. The first outer surface 223, the second outer surface 224, and the third outer surface 225 are the outer surfaces of the female cone 22. The electrical resistivity and the thickness of the coating film 23 were in the same ranges as those of the male cone 21.

Then, a PC structure 10 as illustrated in FIG. 1 was formed by using the male cone 21, the female cone 22, and a PC steel strand that serves as a tendon 12 and is made of stainless steel.

In the PC structure 10, saline water was sprayed around the anchorage 20 disposed on a first surface 11A of a concrete structure 11, and a rusting test was performed to measure the time it takes for rust to form between the anchorage 20 and the tendon 12. Among surfaces of the anchorage 20 and the tendon 12, portions where the anchorage 20 and the tendon 12 do not contact each other were covered with a silicone sealant. Then, the rusting test was performed such that rust can be observed at portions where the anchorage 20 and the tendon 12 contact each other.

As a result, it was confirmed that no rust was formed between the anchorage 20 and the tendon 12 in appearance even after 1,000 hours elapsed from the spraying of the saline water. When the anchorage 20 was removed from the tendon 12 after 1,000 hours elapsed, it was confirmed that no rust was formed at a portion where the tendon 12 and the anchorage 20 contact each other.

Experimental Example 2

A coating film 23 made of DLC was provided by the CVD method only on a top portion 711 of each of teeth 71 provided in a first through hole 211 of a male cone 21. The top portion 711 is a contact portion that contacts the tendon 12 when the tendon 12 is gripped. In the Experimental Example 2, portions of the surface 212 of the first through hole 211 other than the top portion 711 were not covered by the coating film 23 and the male cone 21 was exposed.

The coating film 23 made of DLC was provided by the CVD method on the entirety of a first outer surface 213, a second outer surface 214, and a third outer surface 215, which are the outer surfaces of the male cone 21.

The electrical resistivity was measured at any 3 points on the coating film 23 by the two-terminal method. The electrical resistivity was in the range of $10^5$ Ω·m to $10^6$ Ω·m. In addition, an anchorage was produced under the same conditions and was cut by the FIB apparatus so as to expose a cross section along the thickness of the coating film 23, and the cross section was observed by scanning electron microscopy. As a result, it was confirmed that the thickness of the coating film was in the range of 0.5 μm to 5 μm.

The male cone 21 and a female cone 22 were prepared under the same conditions as in the Experimental Example 1, except that the coating film 23 was provided only on a portion of the surface 212 of the first through hole 211 of the male cone 21 as described above. Further, a PC structure 10 was formed under the same conditions as in the Experimental Example 1 except that the above-described male cone 21 was used. Then, a rusting test was performed.

As a result, it was confirmed that no rust was formed between the anchorage 20 and the tendon 12 in appearance even after 1,000 hours elapsed from spraying of saline water. When the anchorage 20 was removed from the tendon 12 after 1,000 hours elapsed, it was confirmed that no rust was formed at a portion where the tendon 12 and the anchorage 20 contact each other.

Experimental Example 3

A PC structure 10 was formed under the same conditions as in the Experimental Example 1 except that an anchorage 20 including no coating film 23 was used. Except that no coating film 23 was included, the anchorage 20 had the same configuration as that of the Experimental Example 1. Then, a rusting test was performed. The time until rust formed between the anchorage 20 and the tendon 12 was visually confirmed was 5 hours.

Although the embodiments have been described in detail above, the present invention is not limited to a specific embodiment, and various modifications and alterations can be made within the scope described in the claims.

What is claimed is:

1. An anchorage for gripping and fixing an end portion of a tendon, the anchorage comprising:

a base having a surface; and a coating film provided only on a contact portion of the surface of the base to minimize corrosion between the tendon and the anchorage, the contact portion contacting the tendon when the tendon is gripped by the anchorage, wherein the coating film has an electrical resistivity of $10^4$ Ω·m or more.

2. The anchorage according to claim 1, wherein the coating film has a thickness of 50 nm or more and 100 μm or less.

3. The anchorage according to claim 1, wherein the base includes a male cone and a female cone, the male cone having a first through hole into which the tendon is inserted, and the female cone having a second through hole into which the male cone is inserted.

4. The anchorage according to claim 3, wherein the contact portion is a portion of a surface of the first through hole of the male cone.

5. The anchorage according to claim 3, wherein the male cone has a plurality of teeth on a surface of the first through hole.

6. The anchorage according to claim 3, wherein the coating film provided in the first through hole has a hardness of 500 HV or more and 10,000 HV or less.

7. A prestressed concrete (PC) structure comprising:

a tendon; and the anchorage of claim 1 attached to an end portion of the tendon.

8. The PC structure according to claim 7, wherein the tendon is one or more selected from a PC steel wire made of stainless steel, a PC steel wire having a zinc coating, a PC steel wire having a copper coating, and a carbon fiber composite cable.

9. The anchorage according to claim 3, wherein the contact portion is an inner circumference of the first through hole of the male cone.

10. The anchorage according to claim 3, wherein the male cone includes a plurality of male cone members arranged along a circumferential direction of the male cone, and the contact portion includes inner surfaces of the plurality of male cone members.

11. A prestressed concrete (PC) structure comprising:

a concrete structure;

a tendon; and an anchorage configured to fix the tendon to the concrete structure, the anchorage being attached to an end portion of the tendon outside the concrete structure, the anchorage including a base having a surface, and a coating film provided only on a contact portion of the surface of the base to minimize corrosion between the tendon and the anchorage, the contact portion contacting the tendon in a state in which the tendon is gripped by the anchorage.

* * * * *